US011440697B2

(12) United States Patent
Holley, Jr.

(10) Patent No.: US 11,440,697 B2
(45) Date of Patent: Sep. 13, 2022

(54) CARTON FOR A FOOD PRODUCT

(71) Applicant: Graphic Packaging International, LLC, Atlanta, GA (US)

(72) Inventor: John Murdick Holley, Jr., Lawrenceville, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 143 days.

(21) Appl. No.: 16/793,357

(22) Filed: Feb. 18, 2020

(65) Prior Publication Data

US 2020/0277098 A1 Sep. 3, 2020

Related U.S. Application Data

(60) Provisional application No. 62/811,594, filed on Feb. 28, 2019.

(51) Int. Cl.
*B65D 5/18* (2006.01)
*B65D 5/20* (2006.01)
*B65D 5/30* (2006.01)

(52) U.S. Cl.
CPC ..... *B65D 5/18* (2013.01); *B65D 5/2023* (2013.01); *B65D 5/2038* (2013.01); *B65D 5/301* (2013.01)

(58) Field of Classification Search
CPC ..... B65D 5/18; B65D 5/2023; B65D 5/2038; B65D 5/301; B65D 5/3685; B65D 31/005;

(Continued)

(56) References Cited

U.S. PATENT DOCUMENTS 662,969 A 12/1900 Roth
978,569 A 12/1910 Elkin
(Continued)

FOREIGN PATENT DOCUMENTS

CA 2 586 472 5/2006
DE 75 23 198 11/1975
(Continued)

OTHER PUBLICATIONS

Southern Champion Tray 0723 French Fry Scoop. [online] Retrieved Jun. 3, 2020 from URL: https://www.amazon.com/ Southern-Champion-Tray-0723-Approximately/dp/B004LTDIH8.
(Continued)

*Primary Examiner* — Christopher R Demeree
(74) *Attorney, Agent, or Firm* — Womble Bond Dickinson (US) LLP

(57) ABSTRACT

A carton for holding at least one food product includes a plurality of panels extending at least partially around an interior of the carton, the plurality of panels includes a bottom panel, a front panel, and a back panel. At least one side end flap is foldably connected to one of the front panel and the back panel, and the front panel, the back panel, and the at least one side end flap cooperate to form an open top of the carton for accessing the interior of the carton. The at least one side end flap has a first locking feature and the other of the front panel and the back panel has a second locking feature, engagement of the first locking feature and the second locking feature secures the at least one side end flap to the other of the front panel and the back panel.

31 Claims, 6 Drawing Sheets

(58) Field of Classification Search
CPC .. B65D 5/0209; B65D 5/48016; B65D 75/14; A47G 21/001
USPC ..... 229/193, 400, 904, 405, 902, 117.05, 229/194; 493/121; 206/541
See application file for complete search history.

(56) References Cited

U.S. PATENT DOCUMENTS 1,516,090 A 11/1924 Gary et al.
1,651,848 A 12/1927 Stevens
1,667,376 A 4/1928 Fehrenkamp
1,814,561 A 7/1931 Krumm
1,824,862 A 9/1931 Young
1,883,852 A * 10/1932 Medoff ..... B65D 77/02 206/449
2,100,888 A 11/1937 Vine
2,107,946 A 2/1938 Inman
2,132,966 A 11/1938 O'Brien
2,312,595 A 3/1943 Smith
2,323,287 A * 7/1943 Amberg ..... B65D 3/02 229/400
2,345,000 A 3/1944 Newsom
2,363,861 A 11/1944 Goodyear
2,565,146 A 8/1951 Okon
2,583,915 A 1/1952 Whitley
2,804,252 A 8/1957 Nute
2,844,294 A 7/1958 Williams
2,955,733 A 10/1960 Wilson
2,967,610 A 1/1961 Ebert
3,107,039 A 10/1963 Painter
3,142,430 A 7/1964 Meyers
3,204,814 A 9/1965 Mahon
3,240,419 A 3/1966 Spiering et al.
3,324,998 A 6/1967 Farquhar
3,515,331 A 6/1970 Guthrie
3,630,430 A 12/1971 Struble
3,637,130 A 1/1972 Farquhar
3,684,157 A 8/1972 Mendez
3,809,310 A 5/1974 VanderLugt, Jr.
3,876,131 A 4/1975 Tolaas
3,907,195 A 9/1975 Struble
4,008,849 A 2/1977 Baber
4,039,120 A 8/1977 Herzog
4,088,262 A 5/1978 Kuehlhorn
4,105,155 A 8/1978 Forbes, Jr.
4,228,945 A 10/1980 Wysocki
4,267,955 A 5/1981 Struble
4,313,542 A 2/1982 Roberts et al.
4,477,014 A 10/1984 Brandenburger
4,492,333 A 1/1985 Roberts
4,502,623 A 3/1985 Moore, Jr.
4,530,459 A 7/1985 Maroszek
4,592,914 A 6/1986 Kuchenbecker
4,694,987 A 9/1987 Forbes, Jr.
4,711,389 A 12/1987 Alba
4,714,190 A 12/1987 Morrocco
4,718,595 A 1/1988 Jones
4,775,771 A 10/1988 Pawlowski et al.
4,798,323 A 1/1989 Platt
4,815,609 A 3/1989 Kiedaisch
4,865,921 A 9/1989 Hollenberg et al.
D305,304 S 1/1990 McCaleb
4,890,439 A 1/1990 Smart
4,919,785 A 4/1990 Willey et al.
4,936,935 A 6/1990 Beckett
4,955,528 A 9/1990 Schluckebier
4,963,424 A 10/1990 Beckett
4,993,625 A 2/1991 Stease et al.
5,034,234 A 7/1991 Andreas et al.
5,039,364 A 8/1991 Beckett et al.
5,047,710 A 9/1991 Mahoney
5,071,062 A 12/1991 Bradley et al.
5,078,273 A 1/1992 Kuchenbecker
5,093,364 A 3/1992 Richards
5,096,723 A 3/1992 Turpin
5,108,000 A 4/1992 Stoll
5,117,078 A 5/1992 Beckett
5,118,033 A 6/1992 Kula
5,137,210 A 8/1992 Hibbs
5,175,404 A 12/1992 Andreas et al.
5,213,902 A 5/1993 Beckett
5,221,419 A 6/1993 Beckett
5,260,537 A 11/1993 Beckett
5,266,386 A 11/1993 Beckett
5,266,763 A 11/1993 Colombo
5,300,748 A 4/1994 Colombo
RE34,683 E 8/1994 Maynard et al.
5,338,921 A 8/1994 Maheux et al.
5,340,436 A 8/1994 Beckett
5,354,973 A 10/1994 Beckett
5,402,931 A 4/1995 Gulliver et al.
5,410,135 A 4/1995 Pollart et al.
5,417,364 A 5/1995 Shaw
5,424,517 A 6/1995 Habeger, Jr. et al.
5,458,283 A 10/1995 Southwell et al.
5,484,100 A 1/1996 Rigby
5,503,324 A 4/1996 Bacchetti et al.
5,510,132 A 4/1996 Gallo, Jr.
5,519,195 A 5/1996 Keefer et al.
D370,412 S 6/1996 Rohrer
5,540,333 A * 7/1996 Gonzalez ..... B65D 31/005 206/541
D373,081 S 8/1996 Bridger
5,542,536 A 8/1996 Sutherland
D376,311 S 12/1996 Burton
5,582,345 A 12/1996 Lankhuijzen
5,585,027 A 12/1996 Young
5,626,283 A 5/1997 Mellon
5,628,921 A 5/1997 Beckett
5,630,544 A 5/1997 Shane
5,672,407 A 9/1997 Beckett
5,688,427 A 11/1997 Gallo, Jr.
5,697,549 A 12/1997 Yocum
5,704,483 A 1/1998 Groh
5,707,004 A 1/1998 Cai
5,720,429 A 2/1998 Cordle
5,726,426 A 3/1998 Davis et al.
D395,005 S 6/1998 Burton
5,759,422 A 6/1998 Schmelzer et al.
5,800,724 A 9/1998 Habeger et al.
5,842,631 A 12/1998 Berger
5,938,110 A 8/1999 Bernstein
6,063,415 A 5/2000 Walters
6,102,208 A 8/2000 Huang
6,102,568 A 8/2000 Davis
6,114,679 A 9/2000 Lai
6,150,646 A 11/2000 Lai et al.
6,204,492 B1 3/2001 Zeng et al.
6,216,946 B1 4/2001 Cai
6,230,969 B1 5/2001 Spransy
6,251,451 B1 6/2001 Zeng
6,360,944 B1 3/2002 Gorman
6,394,297 B1 5/2002 Nance
6,394,338 B1 5/2002 Sluder
6,414,290 B1 7/2002 Cole et al.
6,419,153 B1 7/2002 Malta
6,433,322 B2 8/2002 Zeng et al.
6,440,050 B1 8/2002 Capparelli
6,455,827 B2 9/2002 Zeng
6,552,315 B2 4/2003 Zeng et al.
6,634,547 B2 * 10/2003 Willis ..... B65D 5/3685 229/117.05
6,644,540 B2 11/2003 Jamitzky
6,677,563 B2 1/2004 Lai
6,683,289 B2 1/2004 Whitmore et al.
6,695,202 B2 2/2004 Miess
6,717,121 B2 4/2004 Zeng et al.
6,719,190 B2 4/2004 Yocum
6,744,028 B2 6/2004 Chisholm et al.
6,765,182 B2 7/2004 Cole et al.
6,866,189 B2 3/2005 Nelson
D510,520 S 10/2005 Butler et al.
6,966,483 B2 11/2005 Manninen
7,019,271 B2 3/2006 Wnek et al.

(56) References Cited

U.S. PATENT DOCUMENTS

| | | | |
|---|---|---|---|
| D523,744 | S | 6/2006 | Zeng |
| D532,690 | S | 11/2006 | Oliveira |
| 7,159,760 | B2 | 1/2007 | Pluck et al. |
| 7,182,242 | B2 | 2/2007 | Cai |
| D560,104 | S | 1/2008 | Schomaker |
| 7,323,699 | B2 | 1/2008 | Hopkins et al. |
| 7,365,292 | B2 | 4/2008 | Cole et al. |
| 7,414,230 | B2 | 8/2008 | Fitzwater |
| 7,473,875 | B2 | 1/2009 | Fitzwater |
| 7,514,659 | B2 | 4/2009 | Lafferty |
| 7,617,969 | B2 | 11/2009 | Oliveira |
| 7,621,439 | B2 | 11/2009 | McClure |
| 7,652,233 | B2 | 1/2010 | Keefe |
| 7,667,167 | B2 | 2/2010 | Fitzwater |
| 7,893,389 | B2 | 2/2011 | Fitzwater |
| D633,810 | S | 3/2011 | Jenkins |
| 7,938,267 | B2 | 5/2011 | Cross |
| 7,982,167 | B2 | 7/2011 | Fitzwater |
| D661,161 | S | 6/2012 | Craft |
| 8,309,896 | B2 | 11/2012 | Fitzwater |
| D672,202 | S | 12/2012 | Craft |
| D673,865 | S | 1/2013 | DeBusk |
| 8,365,980 | B2 | 2/2013 | Wettlaufer |
| 8,794,465 | B2 | 8/2014 | Okoniewski |
| 8,814,033 | B2 | 8/2014 | House |
| 8,960,478 | B2 | 2/2015 | Crye |
| D725,445 | S | 3/2015 | Braithwaite |
| 9,010,074 | B2 | 4/2015 | Lemke |
| 9,499,296 | B2 | 11/2016 | Mills et al. |
| D790,989 | S | 7/2017 | Butler et al. |
| D842,095 | S | 3/2019 | Hajek |
| 10,329,049 | B2 * | 6/2019 | Learn ..... B65D 5/18 |
| 2002/0125306 | A1 | 9/2002 | Jamitzky |
| 2003/0080120 | A1 | 5/2003 | Whitmore et al. |
| 2003/0106926 | A1 | 6/2003 | Beatificato et al. |
| 2003/0141355 | A1 | 7/2003 | McLean, III |
| 2003/0206997 | A1 | 11/2003 | Winkelman et al. |
| 2004/0089656 | A1 | 5/2004 | Watkins |
| 2004/0101605 | A1 | 5/2004 | Sigel |
| 2004/0159698 | A1 | 8/2004 | Tallevi et al. |
| 2005/0284865 | A1 | 12/2005 | Fogle et al. |
| 2006/0016863 | A1 | 1/2006 | Holt |
| 2006/0022024 | A1 | 2/2006 | Krimsky |
| 2006/0049190 | A1 | 3/2006 | Middleton |
| 2006/0096978 | A1 | 5/2006 | Lafferty et al. |
| 2006/0113300 | A1 | 6/2006 | Wnek et al. |
| 2006/0180644 | A1 | 8/2006 | Baker |
| 2006/0278521 | A1 | 12/2006 | Stowell |
| 2007/0045338 | A1 | 3/2007 | Butler |
| 2007/0131742 | A1 | 6/2007 | Fitzwater |
| 2007/0131743 | A1 | 6/2007 | Fitzwater |
| 2007/0131744 | A1 | 6/2007 | Fitzwater |
| 2007/0131745 | A1 | 6/2007 | Fitzwater |
| 2007/0138247 | A1 | 6/2007 | Fitzwater |
| 2007/0251942 | A1 | 11/2007 | Cole et al. |
| 2007/0251943 | A1 | 11/2007 | Wnek et al. |
| 2007/0275130 | A1 | 11/2007 | Cole et al. |
| 2008/0000897 | A1 | 1/2008 | Robbins et al. |
| 2008/0047958 | A1 | 2/2008 | Cole et al. |
| 2008/0078759 | A1 | 4/2008 | Wnek et al. |
| 2008/0081095 | A1 | 4/2008 | Cole et al. |
| 2008/0179385 | A1 | 7/2008 | Nikolai et al. |
| 2008/0290149 | A1 | 11/2008 | Sweet |
| 2008/0308614 | A1 | 12/2008 | Fitzwater |
| 2009/0039077 | A1 | 2/2009 | Fitzwater |
| 2009/0090708 | A1 | 4/2009 | Requena et al. |
| 2009/0200364 | A1 | 8/2009 | Oliveira |
| 2010/0051675 | A1 | 3/2010 | Sweet |
| 2010/0055260 | A1 | 3/2010 | Sweet |
| 2010/0243510 | A1 | 9/2010 | Cross |
| 2012/0292382 | A1 | 11/2012 | Cai |
| 2018/0305066 | A1 | 10/2018 | Robertson |

FOREIGN PATENT DOCUMENTS

| | | |
|---|---|---|
| DE | 296 13 331 | 10/1996 |
| DE | 203 00 817 | 4/2003 |
| EP | 0 270 838 | 6/1988 |
| EP | 1 452 458 | 9/2004 |
| EP | 1 481 922 | 12/2004 |
| FR | 2 516 481 | 5/1983 |
| FR | 2 665 882 | 2/1992 |
| FR | 2 687 384 | 8/1993 |
| FR | 2 867 346 | 9/2005 |
| GB | 2 365 000 | 2/2002 |
| JP | 4-253670 | 9/1992 |
| JP | 03095906 | 6/2003 |
| JP | 2004 224402 | 8/2004 |
| JP | 03106317 | 10/2004 |
| JP | 2007-168832 | 7/2007 |
| JP | 2012-245989 | 12/2012 |
| KR | 20-0253232 | 11/2001 |
| KR | 10-0863770 | 10/2008 |
| KR | 10-2013-0042705 A | 4/2013 |
| WO | WO 91/05448 | 4/1991 |
| WO | WO 94/05563 | 3/1994 |
| WO | WO 02/40374 | 5/2002 |
| WO | WO 03/066435 | 8/2003 |
| WO | WO 2005/077783 | 8/2005 |
| WO | WO 2005/085091 | 9/2005 |
| WO | WO 2006/052326 | 5/2006 |
| WO | WO 2006/076501 | 7/2006 |
| WO | WO 2007/067705 | 6/2007 |
| WO | WO 2007/127235 | 11/2007 |
| WO | WO 2007/133659 | 11/2007 |
| WO | WO 2007/136839 | 11/2007 |
| WO | WO 2008/137525 | 11/2008 |
| WO | WO 2008/137528 | 11/2008 |
| WO | WO 2009/023286 | 2/2009 |

OTHER PUBLICATIONS

International Search Report and Written Opinion for PCT/US2020/018582 dated Jun. 19, 2020.

* cited by examiner

CARTON FOR A FOOD PRODUCT

CROSS-REFERENCE TO RELATED APPLICATION

This application claims the benefit of U.S. Provisional Patent Application No. 62/811,594, filed on Feb. 28, 2019.

INCORPORATION BY REFERENCE

The disclosure of U.S. Provisional Patent Application No. 62/811,594, filed on Feb. 28, 2019, is hereby incorporated by reference for all purposes as if presented herein in its entirety.

BACKGROUND OF THE DISCLOSURE

The present disclosure generally relates to cartons for holding and dispensing food products.

SUMMARY OF THE DISCLOSURE

According to one aspect of the disclosure a carton for holding at least one food product comprises a plurality of panels extending at least partially around an interior of the carton, the plurality of panels comprising a bottom panel, a front panel, and a back panel. The carton further comprises at least one side end flap foldably connected to one of the front panel and the back panel, the front panel, the back panel, and the at least one side end flap cooperate to form an open top of the carton for accessing the interior of the carton. The at least one side end flap has a first locking feature and the other of the front panel and the back panel has a second locking feature, engagement of the first locking feature and the second locking feature secures the at least one side end flap to the other of the front panel and the back panel.

According to another aspect of the disclosure, a blank for forming a carton for holding at least one food product comprises a plurality of panels for extending at least partially around an interior of the carton formed from the blank, the plurality of panels comprising a bottom panel, a front panel, and a back panel. The blank further comprises at least one side end flap foldably connected to one of the front panel and the back panel, the front panel, and the back panel, and the at least one side end flap are for cooperating to form an open top of the carton formed from the blank for accessing the interior of the carton formed from the blank. The at least one side end flap has a first locking feature and the other of the front panel and the back panel has a second locking feature, engagement of the first locking feature and the second locking feature secures the at least one side end flap to the other of the front panel and the back panel when the carton is formed from the blank.

According to another aspect of the disclosure, a method of forming a carton for holding at least one food product comprises obtaining a blank comprising a plurality of panels comprising a bottom panel, a front panel, and a back panel, at least one side end flap foldably connected to one of the front panel and the back panel, the at least one side end flap has a first locking feature and the other of the front panel and the back panel has a second locking feature. The method further comprises folding the plurality of panels at least partially around the interior of the carton, folding the at least one side end flap such that the front panel, the back panel, and the at least one side end flap cooperate to form an open top of the carton for accessing the interior of the carton, and engaging the first locking feature and the second locking feature to secure the at least one side end flap to the other of the front panel and the back panel.

Other aspects, features, and details of the present disclosure can be more completely understood by reference to the following detailed description of exemplary embodiments taken in conjunction with the drawings and from the appended claims.

Those skilled in the art will appreciate the above-stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons (e.g., carriers) with features for containing and facilitating dispensing articles such as food products, cooked food products, fried food products, hot and/or moist articles, etc. The articles can include, but are not limited to, fast food products, take-out products, meal leftovers, and the like, or any combination thereof. Examples of such products include, but are not limited to, fish, chicken (such as chicken nuggets, chicken strips, chicken fingers, etc.), popcorn, peanuts, candy, French fries (such as waffle fries, steak fries, shoestring fries, curly fries, etc.), French toast sticks, sandwich, pizza, calzone, turnover, burrito, or any other food product that may be packaged for consumption by a consumer. In this specification, the terms "inner," "interior," "outer," "exterior," "lower," "bottom," "upper," and "top" indicate orientations determined in relation to fully erected and upright cartons.

As described herein, cartons may be formed by multiple overlapping panels, end flaps, and/or other portions of blanks. Such panels, end flaps, and/or other portions of the blanks can be designated in relative terms to one another, e.g., "first", "second", "third", etc., in sequential or non-sequential reference, without departing from the disclosure.

Figure 1:
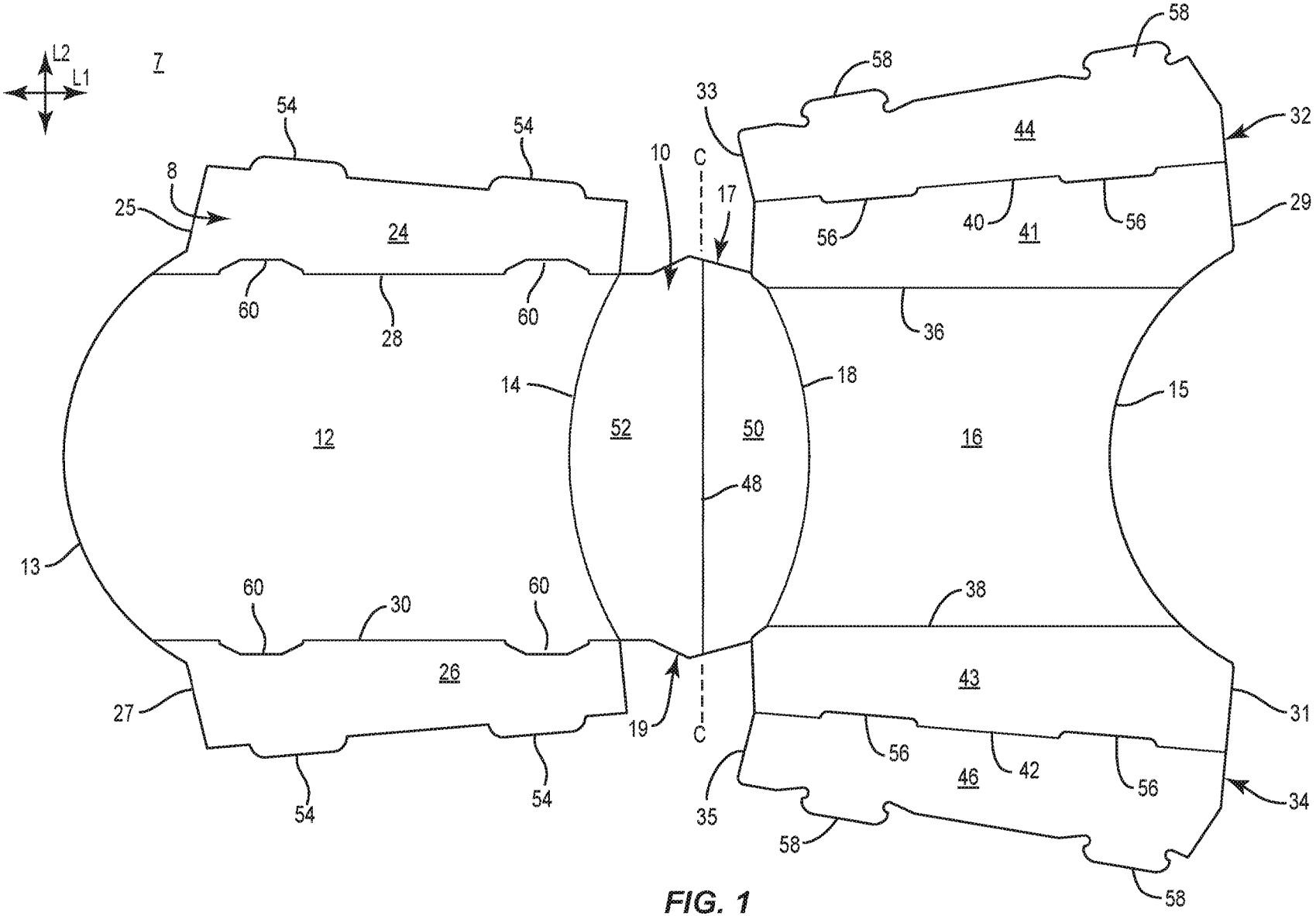
FIG. 1 is a plan view of a blank used to form a carton according to one exemplary embodiment of the disclosure.

FIG. 1 is a plan view of an exterior surface 8 of a blank, generally indicated at 7, used to form a carton 9 (FIG. 5) according to one exemplary embodiment of the disclosure. The carton 9 has an open top 22 that provides access to an interior 21 of the carton 9 such that carton 9 can be used to hold a food product, for example a fast food product (e.g., French fries) in an interior 21 of the carton 9. In one embodiment, the carton 9 can be sized to fit in a hand of a customer and/or can have a generally tapered configuration. In one embodiment, the carton 9 can be used for holding, packaging, and/or serving cooked/fried food products from a fast food or quick service restaurant, but the carton 9 could hold other types of food products or other non-food products without departing from the disclosure.

In the illustrated embodiment, the blank 7 has a longitudinal axis L1 and a lateral axis L2. The blank 7 includes a bottom panel 10 foldably connected to a back panel 12 at a fold line 14 and a front panel 16 foldably connected to the bottom panel 10 at a fold line 18. As shown in FIG. 1, the fold lines 14, 18 connecting the bottom panel 10 to the respective panels 12, 16 are generally arcuate, curved, or crescent-shaped so that the bottom panel 10 is curved toward the interior 21 of the carton 9 (e.g., concave) when the carton 9 is formed, as described further herein.

As also shown, the back panel 12 has a free edge 13 that is curved and generally convex relative to a generally central axis or centerline C of the blank 7 that is collinear with a lateral fold line 48 that extends through the bottom panel 10 such that the curved free edge 13 of the back panel 12 extends from its respective endpoints away from the axis C. Further, the front panel 16 has a free edge 15 that is curved and generally concave relative to the generally central axis C such that the curved free edge 15 of the front panel 16 extends from its respective endpoints toward the axis C. The bottom panel 10 has free edges 17, 19 that extend between the respective endpoints of the fold lines 14, 18.

Still referring to FIG. 1, a first front side end flap 32 (broadly, "first side end flap" or "third side end flap") is foldably connected to the front panel 16 at a longitudinal fold line 36 (broadly, "first fold line"). A second front side end flap 34 (broadly "first side end flap" or "third side end flap") is foldably connected to the front panel 16 at a longitudinal fold line 38 (broadly, "first fold line"). The front side end flaps 32, 34 define respective upper free edges 29, 31.

As shown, the front side end flap 32 includes a base portion 41 foldably connected to the front panel 16 at the fold line 36, and a distal portion 44 foldably connected to the base portion 41 at an oblique fold line 40. Similarly, the front side end flap 34 includes a base portion 43 foldably connected to the front panel 16 at the fold line 38, and a distal portion 46 foldably connected to the base portion 43 at an oblique fold line 42. In this regard, the side end flaps 32, 34 are generally bisected at the respective fold lines 40, 42.

As also shown, a pair of male locking features or locking tabs 58 (broadly, "first locking feature" or "second locking feature" or "first male locking feature") is formed on a distal edge of the distal portion 44 of the end flap 32. Further, a pair of spaced cuts 56 (broadly, "first locking feature" or "second locking feature" or "second female locking feature") is collinear with the fold line 40 to form a pair of female locking features between the distal portion 44 and the base portion 41 of the end flap 32.

Similarly, a pair of the locking tabs 58 is formed on a distal edge of the distal portion 46 of the end flap 34, and a pair of the cuts 56 are collinear with the fold line 42 to form a pair of female locking features between the distal portion 46 and the base portion 43 of the end flap 34. In this regard, the front panel 16 is provided with female locking features due to the placement of the cuts 56.

The blank 7 also has a first back side end flap 24 (broadly, "second side end flap" or "fourth side end flap") foldably connected to the back panel 12 at a longitudinal fold line 28 (broadly, "second fold line"). Similarly, a second back side end flap 26 (broadly, "second side end flap" or "fourth side end flap") is foldably connected to the back panel 12 at a longitudinal fold line 30 (broadly, "second fold line"). The back side end flaps 24, 26 define respective upper free edges 25, 27.

The front side end flap 24, as shown, includes a pair of male locking features or locking tabs 54 (broadly, "first locking feature" or "second locking feature" or "second male locking feature") defined along a free edge of the front side end flap 24.

Similarly, a pair of the locking tabs 54 are defined along a free edge of the front side end flap 26. Further, the back panel 12 has a pair of spaced cuts 60 (broadly, "first locking feature" or "second locking feature" or "first female locking feature") that is collinear with the fold line 28 to form a pair of female locking features adjacent the side end flap 24, and a pair of the cuts 60 is collinear with the fold line 30 to form a pair of female locking features adjacent the side end flap 26.

One or more of the locking tabs 54, 58 can be configured with features for enhanced engagement with the respective cuts 56, 60, for example, hooks, barbs, notches, slits, etc. While the cuts 56, 60 are shown as having curved and/or angled portions, one or more of the cuts 56, 58 could have a different configuration without departing from the disclosure.

As also shown, the bottom panel 10 includes a first portion 50 foldably connected to the front panel 16 at the fold line 18, and a second portion 52 that is foldably connected to the back panel 12 at the fold line 14. The first portion 50 of the bottom panel 10 is foldably connected to the second portion 52 at the lateral fold line 48 such that the bottom panel 10 is generally bisected at the fold line 48.

As described herein, the respective locking tabs 58 are configured for at least partial insertion through the respective cuts 60 such that the locking tabs 58 and cuts 60 can be considered as a set of first locking features of the carton 9. Similarly, the respective locking tabs 54 are configured for at least partial insertion through the respective cuts 56 such that the locking tabs 54 and cuts 56 can be considered a set of second locking features of the carton 9.

It will be understood that one or more of the bottom panel 10, the front panel 16, the back panel 12, and the side end flaps 24, 26, 32, 34 could be otherwise shaped, arranged, positioned, and/or configured without departing from the disclosure.

Figure 2:
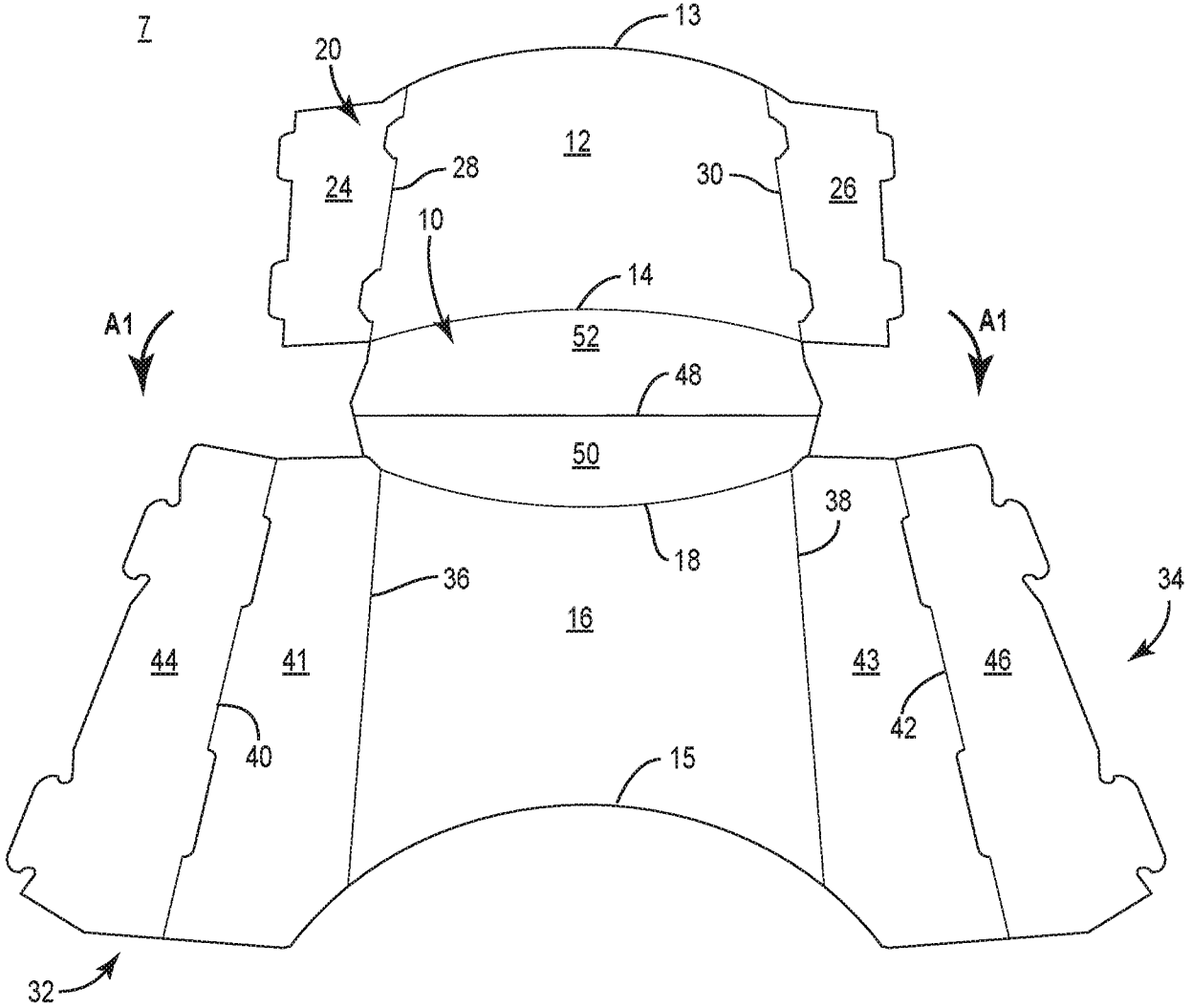
FIG. 2 is a first sequential perspective view of a folding of the blank of FIG. 1.
Figure 3:
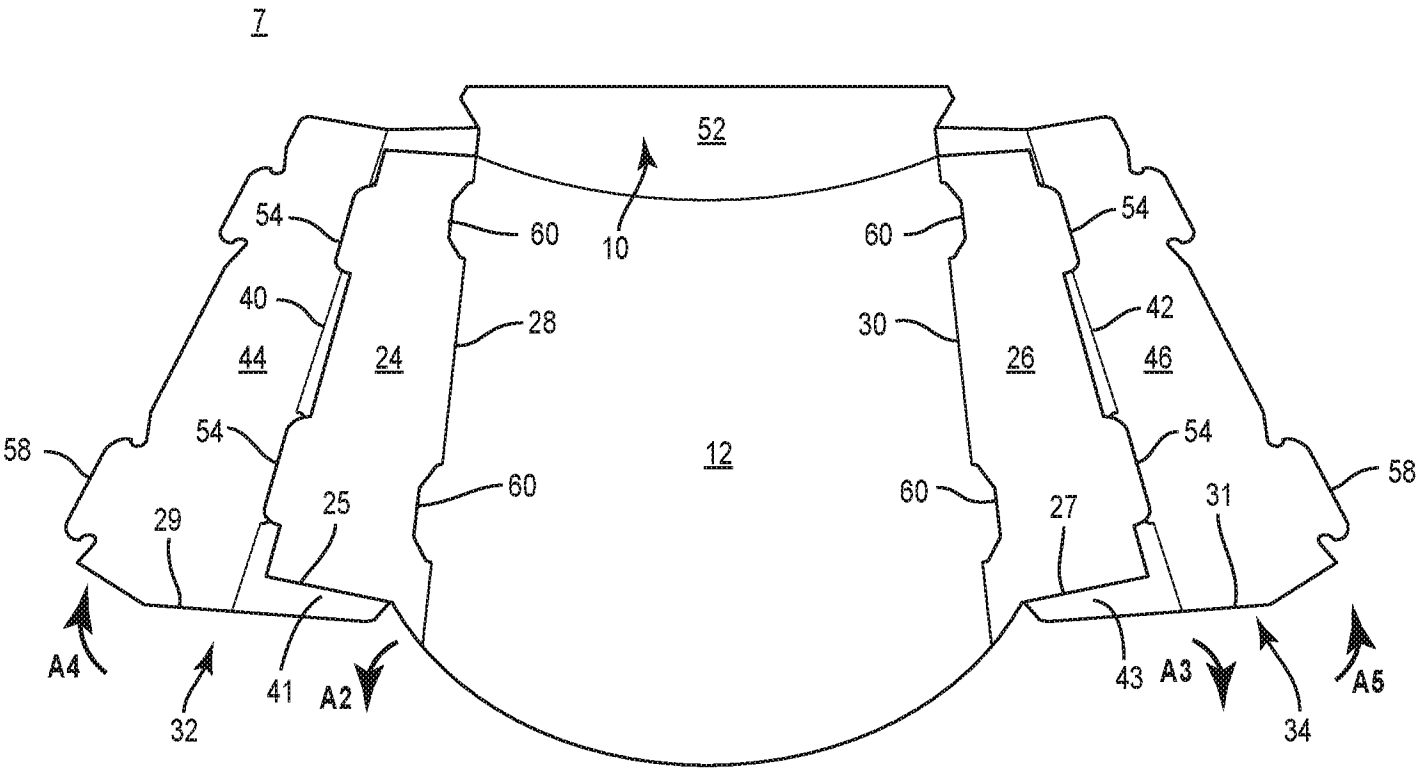
FIG. 3 is a second sequential perspective view of a folding of the blank of FIG. 1.
Figure 4:
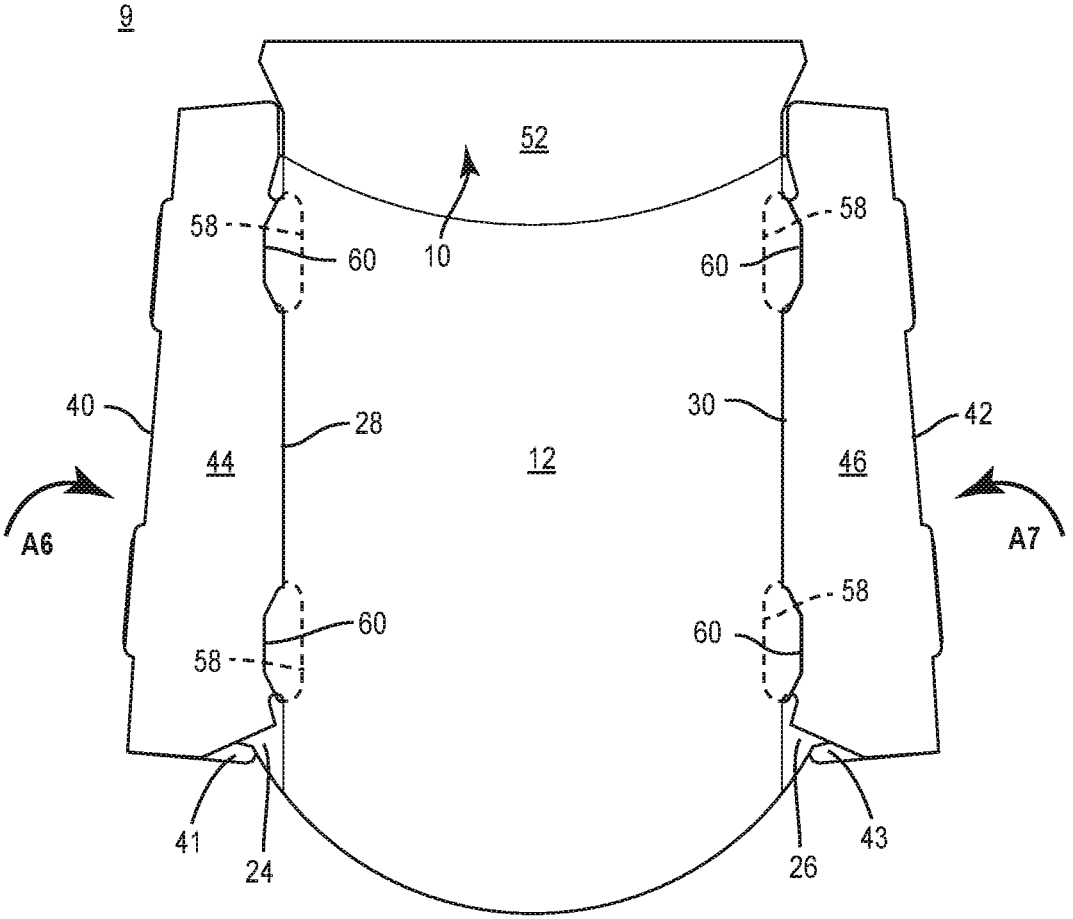
FIG. 4 is a third sequential perspective view of a folding of the blank of FIG. 1.

Referring additionally to FIGS. 2-4, formation of the carton 9 from the blank 7 according to one exemplary embodiment of the disclosure is illustrated. It will be understood that the blank 7 can be folded about edges/surfaces of a folding body such as a mandrel, can be folded manually, and/or can be folded with specialized or generalized machinery.

As shown in FIGS. 2-4, the blank 7 can be positioned with the exterior surface 8 facing down and an interior surface 20 facing up, and the back panel 12 and the second portion 52 of the bottom panel 10 can together be folded at the fold line 48 in the direction of the arrows A1 into at least partial face-to-face contact with the respective first portion 50 of the bottom panel 10 and the front panel 16. In such an arrangement, an upper portion of the back panel 12 defined by the curved edge 13 protrudes past an upper portion of the front panel 16 defined by the curved edge 15.

As shown in FIG. 3, the respective side end flaps 24, 26 can be folded at the respective fold lines 28, 30 in the direction of the respective arrows A2, A3. Such folding of the side end flaps 24, 26 can have the effect of urging the respective base portions 41, 43 of the respective side end flaps 32, 34 to fold at the respective fold lines 36, 38 in the direction of the respective arrows A2, A3.

Simultaneously or thereafter, the respective distal portions 44, 46 of the respective side end flaps 32, 34 can be folded upwardly at the respective fold lines 40, 42 in the direction of the respective arrows A4, A5 into at least partial face-to-face contact with the respective side end flaps 24, 26 such that the side end flap 24 is disposed between and in at least partial face-to-face contact with each of the base portion 41 and the distal portion 44 of the side end flap 32, and the side end flap 26 is disposed between and in at least partial face-to-face contact with each of the base portion 43 and the distal portion 46 of the side end flap 34.

This configuration also positions the respective locking tabs 54 to at least partially extend through the respective cuts 56. In this regard, the cuts 56 at least partially receive the respective locking tabs 54 in a locking engagement that secures the end flaps 24, 26 to the front panel 16.

Referring additionally to FIG. 4, the respective distal portions 41, 43 and the respective base portions 44, 46 of the respective side end flaps 32, 34 can be maintained in substantially planar and parallel relation as the respective base portions 41, 43 are folded upwardly at the respective fold lines 36, 38 in the direction of the respective arrows A6, A7. In such an arrangement, the respective folded side end flaps 32, 34 are positioned in substantially planar relation to the front panel 16 and back panel 12, and are positioned such that the respective locking tabs 58 protruding from the respective distal portions 44, 46 of the respective side end flaps 32, 34 extend at least partially through the respective cuts 60 into the interior 21 of the carton 9. In this regard, the cuts 60 at least partially receive the respective locking tabs 58 to provide a locking engagement that secures the end flaps 32, 34 to the back panel 12.

Figure 5:
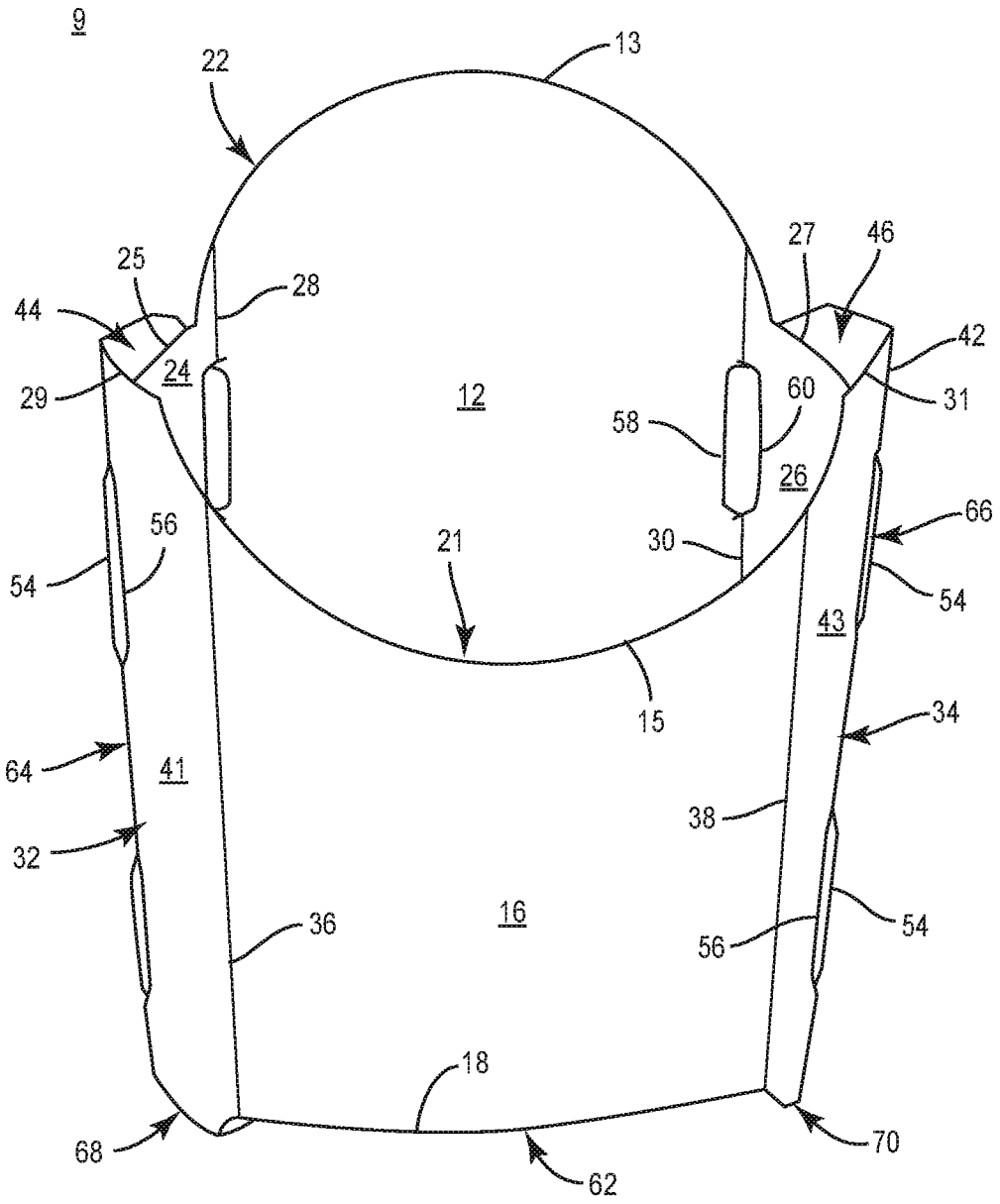
FIG. 5 is a front perspective view of a carton formed from the blank of FIG. 1 according to the first exemplary embodiment of the disclosure.
Figure 6:
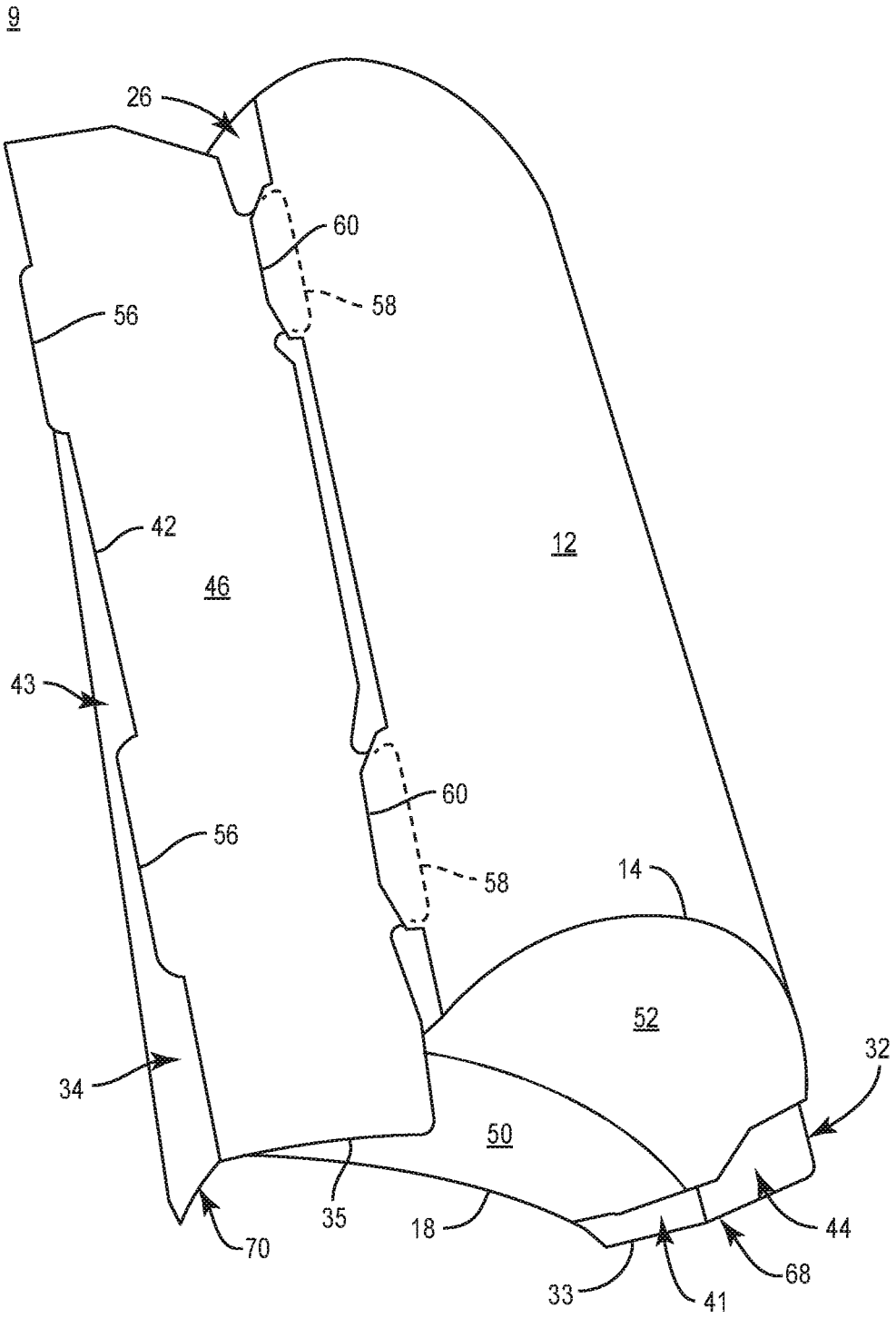
FIG. 6 is a back perspective view of the carton of FIG. 5.

As shown in FIGS. 5 and 6, the aforementioned folded configuration of the carton 9 can be expanded to at least partially surround the interior 21 of the carton 9, e.g., such that the respective portions 50, 52 of the bottom panel 10 fold at the respective fold lines 18, 14 and further at the fold line 48 into an arrangement that forms a curved or angled bottom 62 of the carton 9.

Such expansion of the carton 9 also at least partially unfolds the arrangement of the side end flaps 24, 26, 32, 34, e.g., such that the side end flap 24 is in at least partial face-to-face contact with the distal portion 44 of the side end flap 32, and the side end flap 24 and the distal portion 44 of the side end flap 32 are together obliquely disposed relative to the base portion 41 of the side end flap 32. Similarly, the side end flap 26 is positioned in at least partial face-to-face contact with the distal portion 46 of the side end flap 34, and the side end flap 26 and the distal portion 46 of the side end flap 34 are together obliquely disposed relative to the base portion 43 of the side end flap 34.

Expansion of the carton 9 can also cause the front panel 12 and/or the back panel 16 to bow/flex/curve between the respective fold lines 28, 30 and fold lines 36, 39. In this regard, the front panel 16, the back panel 12, and the side end flaps 32, 34, 24, 26 cooperate to form the open top 22 of the carton 9 through which the interior 21 of the carton 9 can be accessed. In particular, the free edge 15 of the front panel 16, the free edge 13 of the back panel 12, the free edge 29 of the front side end flap 32, the free edge 31 of the front side end flap 34, the free edge 25 of the back side end flap 25 and the free edge 27 of the back side end flap 26 define the open top 22 of the carton 9.

Such an arrangement provides a first side panel 64 (broadly, "first closed end of the carton" or "second closed end of the carton") and a second side panel 66 (broadly, "first closed end of the carton" or "second closed end of the carton") that each include an at least partial multi-ply, e.g., two-ply, configuration. The first side panel 64 includes the side end flap 24 in at least partial face-to-face contact with distal portion 44 of the side end flap 32, and with the base portion 41 of the side end flap 32 extending obliquely therefrom. Similarly, the side panel 66 includes the side end flap 26 in at least partial face-to-face contact with the distal portion 46 of the side end flap 34, and with the base portion 43 of the side end flap 34 extending obliquely therefrom.

Furthermore, the oblique arrangement of the respective portions of the side panels 64, 66 present respective angled surfaces that extend between the respective front and back panels 16, 12, for example, to provide a comfortable/ergonomic gripping surface for a customer that is convenient, comfortable, and secure.

In addition, bottom free edges 33, 35 of the respective side end flaps 32, 34 protrude below the bottom panel 10 and the respective front and back panels 16, 12 to define respective angled supports or angled legs 68, 70 upon which the carton 9 can rest in an upright configuration. The legs 68, 70 can provide a stable surface that inhibits or prevents tipping or tilting of the carton 9 in the upright configuration, e.g., so that a customer can retrieve food products from the interior 21 of the carton 9 without the need to manually position or maintain the carton 9 in an upright position.

In this regard, the disclosed carton 9 includes side panels 64, 66 to provide a robust structure for holding one or more food products at least partially in the interior 21 thereof. In addition, the set of first locking features provided by the respective tabs 58 and respective cuts 60 and the set of second locking features provided by the respective tabs 54 and the respective cuts 56 provides a secure engagement among the panels 10, 12, 16, 24, 26, 64, 66 to maintain the carton 9 in an erected configuration through the arrangement of interlocking structures. Such an arrangement can obviate the need for additional materials to maintain the carton 9 in the erected configuration, for example, adhesives such as glue. In this regard, the carton 9 can be formed from a unitary piece of material that is devoid of adhesives such as glue, and without the need to incorporate additional securing materials such that material can be selected for the blank 7/carton 9 with desired properties, e.g., recyclability and/or biodegradability. In one embodiment, such unitary material can be paperboard.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blanks. In accordance with the above-described embodiments, the blank may be constructed of paperboard of a caliper such that it is heavier and more rigid than ordinary paper. The blanks can also be constructed of other materials, such as cardboard, hard paper, or any other material having properties suitable for enabling the cartons, to function at least generally as described above. The blanks can also be laminated to or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the spaced apart slits to be replaced with a continuous slit, a continuous score, or the like. For example, a cut line can be a continuous slit or could be wider than a slit without departing from the present disclosure. Also, a tear line can be a series of cut scores passing completely, or partially, through the material, that are separated by nicks.

The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding at least one food product, the carton comprising:

a plurality of panels extending at least partially around an interior of the carton, the plurality of panels comprising a bottom panel, a front panel, and a back panel; and a first side end flap foldably connected to the front panel at a first fold line, a second side end flap foldably connected to the back panel at a second fold line, the front panel, the back panel, the first side end flap, and the second side end flap cooperate to form an open top of the carton for accessing the interior of the carton, the first side end flap has a male locking feature, a female locking feature interrupts the second fold line, and engagement of the male locking feature and the female locking feature secures the first side end flap to the back panel.

2. The carton of claim 1, wherein the male locking feature is a locking tab and the female locking feature is a cut.

3. The carton of claim 1, wherein the first side end flap comprises a base portion foldably connected to the front panel and a distal portion foldably connected to the base portion, the male locking feature is formed on a distal edge of the first side end flap.

4. The carton of claim 1, wherein the male locking feature is a first male locking feature, the female locking feature is a first female locking feature, the second side end flap comprises a second male locking feature and the carton further comprises a second female locking feature in the first side end flap.

5. The carton of claim 4, wherein engagement of the second male locking feature and the second female locking feature secures the second side end flap to the front panel.

6. The carton of claim 5, wherein the first side end flap comprises a base portion foldably connected to a distal portion at an oblique fold line.

7. The carton of claim 6, wherein the first female locking feature interrupts the oblique fold line.

8. The carton of claim 4, wherein the first side end flap and the second side end flap are in at least partial face-to-face contact to form a side panel of the carton.

9. The carton of claim 8, wherein the second side end flap overlaps the base portion of the first side end flap.

10. The carton of claim 9, wherein the side panel is a first side panel of the carton, and the carton further comprises a third side end flap foldably connected to the front panel and a fourth side end flap foldably connected to the back panel, the third side end flap and the fourth side end flap are in at least partial face-to-face contact to form a second side panel of the carton.

11. The carton of claim 10, wherein the third side end flap comprises a base portion foldably connected to the front panel and a distal portion foldably connected to the base portion of the third side end flap, the fourth side end flap overlaps the base portion of the third side end flap.

12. The carton of claim 10, wherein a free edge of each of the first side end flap and the second side end flap defines a respective first angled leg and a second angled leg of the carton.

13. A blank for forming a carton for holding at least one food product, the blank comprising:

a plurality of panels for extending at least partially around an interior of the carton formed from the blank, the plurality of panels comprising a bottom panel, a front panel, and a back panel; and a first side end flap foldably connected to the front panel at a first fold line, a second side end flap foldably connected to the back panel at a second fold line, the front panel, the back panel, the first side end flap, and the second side end flap are for cooperating to form an open top of the carton formed from the blank for accessing the interior of the carton formed from the blank, the first side end flap has a male locking feature, a female locking feature interrupts the second fold line, and engagement of the male locking feature and the female locking feature secures the first side end flap to the back panel when the carton is formed from the blank.

14. The blank of claim 13, wherein the male locking feature is a locking tab and the female locking feature is a cut.

15. The blank of claim 13, wherein the first side end flap comprises a base portion foldably connected to the front panel and a distal portion foldably connected to the base portion, the male locking feature is formed on a distal edge of the first side end flap.

16. The blank of claim 13, wherein the male locking feature is a first male locking feature, the female locking feature is a first female locking feature, the second side end flap comprises a second male locking feature, and the carton further comprises a second female locking feature in the first side end flap.

17. The blank of claim 16, wherein engagement of the second male locking feature and the second female locking feature secures the second side end flap to the front panel when the carton is formed from the blank.

18. The blank of claim 17, wherein the first side end flap comprises a base portion foldably connected to a distal portion at an oblique fold line, the first female locking feature interrupts the oblique fold line.

19. The blank of claim 13, wherein the first side end flap comprises a base portion foldably connected to the front panel and a distal portion foldably connected to the base portion of the first side end flap, and the blank further comprises a third side end flap foldably connected to the front panel and a fourth side end flap foldably connected to the back panel, the third side end flap comprises a base portion foldably connected to the front panel and a distal portion foldably connected to the base portion of the third side end flap.

20. A method of forming a carton for holding at least one food product, the method comprising:

obtaining a blank comprising a plurality of panels comprising a bottom panel, a front panel, and a back panel, a first side end flap foldably connected to the front panel at a first fold line, a second side end flap foldably connected to the back panel at a second fold line, the first side end flap has a male locking feature, and a female locking feature interrupts the second fold line;

folding the plurality of panels at least partially around the interior of the carton;

folding the first side end flap and the second side end flap such that the front panel, the back panel, the first side end flap, and the second side end flap cooperate to form an open top of the carton for accessing the interior of the carton; and engaging the male locking feature and the female locking feature to secure the first side end flap to the back panel.

21. The method of claim 20, wherein the male locking feature is a locking tab and the female locking feature is a cut.

22. The method of claim 20, wherein the first side end flap comprises a base portion foldably connected to the front panel and a distal portion foldably connected to the base portion, the male locking feature is formed on a distal edge of the first side end flap.

23. The method of claim 20, wherein the male locking feature is a first male locking feature, the female locking feature is a first female locking feature, the second side end flap comprises a second male locking feature, and the carton further comprises a second female locking feature in the first side end flap.

24. The method of claim 23, wherein engagement of the second male locking feature and the second female locking feature secures the second side end flap to the front panel.

25. The method of claim 24, wherein the first side end flap comprises a base portion foldably connected to a distal portion at an oblique fold line.

26. The method of claim 25, wherein the first female locking feature interrupts the oblique fold line.

27. The method of claim 23, wherein the first side end flap and the second side end flap are in at least partial face-to-face contact to form a side panel of the carton.

28. The method of claim 27, wherein the second side end flap overlaps the base portion of the first side end flap.

29. The method of claim 28, wherein the side panel is a first side panel of the carton, and the carton further comprises a third side end flap foldably connected to the front panel and a fourth side end flap foldably connected to the back panel, the third side end flap and the fourth side end flap are in at least partial face-to-face contact to form a second side panel of the carton.

30. The method of claim 29, wherein the third side end flap comprises a base portion foldably connected to the front panel and a distal portion foldably connected to the base portion of the third side end flap, the fourth side end flap overlaps the base portion of the third side end flap.

31. The method of claim 29, wherein a free edge of each of the first side end flap and the second side end flap defines a respective first angled leg and a second angled leg of the carton.

* * * * *